US008284101B2

(12) United States Patent
Fusco

(10) Patent No.: US 8,284,101 B2
(45) Date of Patent: Oct. 9, 2012

(54) RETRODIRECTIVE ANTENNA SYSTEMS

(75) Inventor: Vincent Francis Fusco, Belfast (GB)

(73) Assignee: The Queen's University of Belfast, Belfast (GB)

( * ) Notice: Subject to any disclaimer, the term of this patent is extended or adjusted under 35 U.S.C. 154(b) by 134 days.

(21) Appl. No.: 12/990,003

(22) PCT Filed: May 1, 2009

(86) PCT No.: PCT/GB2009/050456

§ 371 (c)(1), (2), (4) Date: Dec. 13, 2010

(87) PCT Pub. No.: WO2009/133407

PCT Pub. Date: Nov. 5, 2009

(65) Prior Publication Data

US 2012/0013507 A1 Jan. 19, 2012

(30) Foreign Application Priority Data

May 2, 2008 (GB) ..... 0808010.3

(51) Int. Cl.
*H01Q 1/00* (2006.01)

(52) U.S. Cl. ..... 342/370

(58) Field of Classification Search ..... 342/370
See application file for complete search history.

(56) References Cited

U.S. PATENT DOCUMENTS 4,626,803 A * 12/1986 Holm ..... 332/151
4,806,938 A * 2/1989 Meadows ..... 342/370

OTHER PUBLICATIONS

Marot-Lassauzaie, J., "International Search Report", for PCT/GB2009/050456 as mailed Jan. 14, 2010, 2 pages.

(Continued)

*Primary Examiner* — Jack W Keith
*Assistant Examiner* — Frank J McGue
(74) *Attorney, Agent, or Firm* — Winstead PC

(57) ABSTRACT

A retrodirective antenna system (1) for receiving an incoming signal (15) from an object (13) and directing an outgoing signal (11) back to the object (13), comprising two or more transceiver cells (3), each of which receives a part of the incoming signal, produces a phase conjugate output signal, which output signals from the cells combine to form an outgoing signal (11) directed back to the object (13), wherein each transceiver cell (3) comprises an antenna component (7) which detects the part of the incoming signal, a processor which receives the part of the incoming signal and produces first and second same-side, sideband (SB) signals of the part of the incoming signal, a phase shift system comprising a first phase element which receives the first SB signal and outputs a SB signal having a first phase, and a second phase element which receives the second SB signal and outputs a SB signal having a second phase which is in quadrature with the first phase, and an IQ modulator comprising an I input port, a Q input port and a phase adjuster, which receives the SB signal having the first phase on the I input port and the SB signal having the second phase on the Q input port, or receives the SB signal having the first phase on the Q input port and the SB signal having the second phase on the I input port, and phase adjusts the SB signals to produce an output signal which is the phase conjugate of the part of the incoming signal.

14 Claims, 3 Drawing Sheets

OTHER PUBLICATIONS

Sanz, Juan Vassal'Lo, et al., "Beam Control with Active Reflectarrays", Automatika: Journal for Control Measurement, Electronics, Computing and Communications, [Online] vol. 48, No. 1-2, May 2007, pp. 35-43.

Miyamoto, Ryan Y., et al., "An Active Integrated Retrodirective Transponder for Remote Information Retrieval-on-Demand", IEEE Transactions on Microwave Theory and Techniques, IEEE Service Center, Piscataway, NJ, vol. 49, No. 9, Sep. 1, 2001.

"Advanced Pon Retrodirective Array Phase Conjugate Cell for RCS Applications", 31st European Microwave Conference Proceedings, London, Sep. 25-27, 2001; [Proceedings of the European Microwave Conference, London: CMP, GB, vol. conf. 31, pp. 361-364.

Karode, S.L., et al., "Self-Tracking Duplex Communication Link Using Planar Retrodirective Antennas", IEEE Transactions on Antennas and Propagation, IEEE Service Center, Piscataway, NJ, US, vol. 47, No. 6, Jun. 1, 1999.

Fusco, V., et al., "High-Performance IQ Modulator-Based Phase Conjugator for Modular Retrodirective Antenna Array Implamentation", IEEE Transactions on Microwave Theory and Techniques, [Online] vol. 57, No. 9, Sep. 2009.

* cited by examiner

RETRODIRECTIVE ANTENNA SYSTEMS

The invention relates to retrodirective antenna systems and applications thereof.

There are many uses for retrodirective antenna systems which are able to, inter alia, detect an object, determine its position, lock onto the object and follow its movement, send information to and receive information from the object. Current retrodirective antenna systems require sophisticated electronic components, such as filters, especially if it is desired to transmit and receive signals which are close in frequency. In addition, many retrodirective systems require a reference signal oscillator running at twice the frequency of the signal to be retrodirected. These are difficult and therefore expensive to provide. The present invention seeks to provide retrodirective action whilst reducing the need for such filtering components, and removing the need for a reference signal oscillator running at twice the frequency of the signal to be retrodirected.

According to a first aspect of the invention there is provided a retrodirective antenna system for receiving an incoming signal from an object and directing an outgoing signal back to the object, comprising two or more transceiver cells, each of which receives a part of the incoming signal, produces a phase conjugate output signal, which output signals from the cells combine to form an outgoing signal directed back to the object, wherein each transceiver cell comprises an antenna component which detects the part of the incoming signal, a processor which receives the part of the incoming signal and produces first and second same-side, sideband (SB) signals of the part of the incoming signal, a phase shift system comprising a first phase element which receives the first SB signal and outputs a SB signal having a first phase, and a second phase element which receives the second SB signal and outputs a SB signal having a second phase which is in quadrature with the first phase, an IQ modulator comprising an I input port, a Q input port and a phase adjuster, which receives the SB signal having the first phase on the I input port and the SB signal having the second phase on the Q input port, or receives the SB signal having the first phase on the Q input port and the SB signal having the second phase on the I input port, and phase adjusts the SB signals to produce an output signal which is the phase conjugate of the part of the incoming signal.

The first and second SB signals may be lower sideband (LSB) signals. The phase shift system may output a LSB signal having a first phase and a LSB signal having a second phase which is in quadrature with the first phase. The IQ modulator may receive the LSB signal having the first phase on the Q input port and the LSB signal having the second phase on the I input port, and phase adjust the LSB signals to produce an output signal which is the phase conjugate of the part of the incoming signal.

The first and second SB signals may be upper sideband (USB) signals. The phase shift system may output a USB signal having a first phase and a USB signal having a second phase which is in quadrature with the first phase. The IQ modulator may receive the USB signal having the first phase on the I input port and the USB signal having the second phase on the Q input port, and phase adjust the USB signals to produce an output signal which is the phase conjugate of the part of the incoming signal.

The first and second SB signals may be LSB signals or USB signals. The phase shift system may receive LSB signals and output a LSB signal having a first phase and a LSB signal having a second phase which is in quadrature with the first phase. The phase shift system may receive USB signals and output a USB signal having a first phase and a USB signal having a second phase which is in quadrature with the first phase. The system may comprise a switching mechanism. The switching mechanism may receive the LSB signal having the first phase and the LSB signal having the second phase and switch the LSB signal having the first phase to the Q input port of the IQ modulator and switch the LSB signal having the second phase to the I input port of the IQ modulator. The switching mechanism may receive the USB signal having the first phase and the USB signal having the second phase and switch the USB signal having the first phase to the I input port of the IQ modulator and switch the USB signal having the second phase to the Q input port of the IQ modulator.

The switching mechanism may comprise a first input port, a second input port, a first switch, a second switch, a first output port and a second output port. The first and second switches may comprise single pole, single throw switches. The first and second switches may comprise a switch lever. The first and second switches may be operable to cause their switch lever to contact either a first switch contact or a second switch contact. Control of the operation of the switches may be achieved using commands sent to the switches via control lines.

The processor may comprise a frequency downconverter/mixer unit. The frequency downconverter/mixer unit may comprise diode nonlinear elements. The frequency downconverter/mixer unit may comprise transistor elements biased for nonlinear operation. The frequency downconverter/mixer unit may comprise a frequency downconverter which may downconvert the frequency of the part of the incoming signal from an RF signal to an IF part of the incoming signal. The frequency downconverter may receive a reference signal, and downconvert the frequency of the reference signal from an RF signal to an IF reference signal. The frequency downconverter/mixer unit may comprise a mixer which may receive the IF reference signal and the IF part of the incoming signal, and mix these to produce a mixed signal. The mixed signal may comprise a LSB signal and a USB signal. The mixer may comprise a double balanced mixer.

The processor may comprise a sideband signal filter. This may comprise an operational amplifier. The passband of the operational amplifier may be controlled to pass a SB signal comprising a LSB signal. The passband of the operational amplifier may be controlled to pass a SB signal comprising a USB signal. The sideband signal filter may receive the mixed signal and the passband of the operational amplifier may be controlled to filter out either the LSB signal or the USB signal from the mixed signal, and allow either the USB signal or the LSB signal of the mixed signal to pass. The passband of the operational amplifier may be controlled electronically by varying the capacitance of feedback capacitors of the operational amplifier.

The processor may comprise a tracking phase locked loop (PLL) circuit. The tracking PLL circuit may receive a SB signal and duplicate the SB signal to produce the first and second same-side SB signals. The tracking PLL circuit may receive a LSB signal and duplicate the LSB signal to produce the first and second LSB signals. The tracking PLL circuit may receive a USB signal and duplicate the USB signal to produce the first and second USB signals. The tracking PLL circuit may receive a DC bias signal. The magnitude of the DC bias signal may be varied, to introduce variation in the phase of the SB signals, i.e. to phase modulate the SB signals.

The first and second phase elements may each comprise a feedback amplifier and associated resistors and capacitor. The first phase element may comprise a minus 90 degree phase shifter, and may produce a SB signal having a first phase which has a minus 90 degree phase shift in comparison to the first SB signal. The second phase element may act to pass the second SB signal, without changing its phase, i.e. produce a SB signal having a second phase which has a 0 degree phase shift in comparison to the second SB signal. The SB signal having the first phase and the SB signal having the second phase are phase conjugate signals.

The phase adjuster of the IQ modulator may comprise a 90 degree hybrid coupler, a first mixer and a second mixer. The IQ modulator may further comprise a reference signal input port, and an output port. A reference signal received on the reference signal input port may be input into the 90 degree hybrid coupler. The coupler may produce a first signal which is input into the first mixer and a second signal which is input into the second mixer. The first mixer may receive the first signal from the coupler and the SB signal from the I input port, and act to mix these signals and produce an output signal. The second mixer may receive the second signal from the coupler and the SB signal from the Q input port, and act to mix these signals and produce an output signal. The output signals from the first and second mixers may be combined, and output from the IQ modulator via the output port. The components of the IQ modulator act to phase adjust the SB signals, as necessary, to produce an output signal at the output port which is the phase conjugate of the part of the incoming signal first received from the antenna component of the transceiver cell comprising the IQ modulator.

The IQ modulator may act to upconvert the frequency of the SB signals which it receives, from IF signals to an RF output signal.

The IQ modulator may be used to produce an amplitude modulated, phase conjugate output signal. I, Q bit patterns may be applied to the first and second mixers, in order to switch them on and off, thus amplitude modulating their output signals.

The system may comprise a first LO PLL circuit which inputs a reference signal into the processor. The system may comprise a second LO PLL circuit which inputs a reference signal into the IQ modulator. The first and second LO PLL circuits may be phase synchronised, by receiving a common low frequency input signal and using this to produce their reference signals.

Use of the phase shift system and the IQ modulator (and the switching mechanism when necessary) allows production of an output signal which is very close in frequency to the input signal received by the transceiver cell. Thus the retrodirective antenna system can use a narrow bandwidth for the incoming and outgoing signals. This results in good signal to noise ratio, good 'rejection' of thermal noise, low power and difficulty for a third party to identify or jam the input or output signals.

The outgoing signal may be a wide angle, continuous wave (CW) signal, having a frequency in the radio frequency (RF) range. The incoming signal may be a CW signal, or may comprise some type of modulation.

The retrodirective antenna system may comprise four transceiver cells. The transceiver cells may be arranged in a linear array. The transceiver cells can be arbitrarily positioned with respect to each other. A spacing of greater than zero is provided between the transceiver cells. The spacing may be approximately 0.3λ to approximately 0.8λ, where λ is the wavelength of a signal emitted by the cells.

According to a second aspect of the invention there is provided a method of receiving an incoming signal from an object and directing an outgoing signal back to the object, comprising receiving by each of two or more transceiver cells, a part of the incoming signal, producing a phase conjugate output signal from each of the cells, which output signals combine to form an outgoing signal directed back to the object, wherein for each transceiver cell an antenna component of the transceiver cell detects the part of the incoming signal, a processor of the transceiver cell receives the part of the incoming signal and produces first and second same-side, sideband (SB) signals of the part of the incoming signal, a first phase element of a phase shift system of the transceiver cell receives the first SB signal and outputs a SB signal having a first phase, and a second phase element of the phase shift system of the transceiver cell receives the second SB signal and outputs a SB signal having a second phase which is in quadrature with the first phase, an I input port of an IQ modulator of the transceiver cell receives the SB signal having the first phase, and a Q input port of the IQ modulator of the transceiver cell receives the SB signal having the second phase, or the I input port of the IQ modulator of the transceiver cell receives the SB signal having the second phase, and the Q input port of the IQ modulator of the transceiver cell receives the SB signal having the first phase, and a phase adjuster of the IQ modulator of the transceiver cell phase adjusts the SB signals to produce an output signal which is the phase conjugate of the part of the incoming signal.

An embodiment of the invention will now be described by way of example only, with reference to the accompanying drawings, in which.

Figure 1:
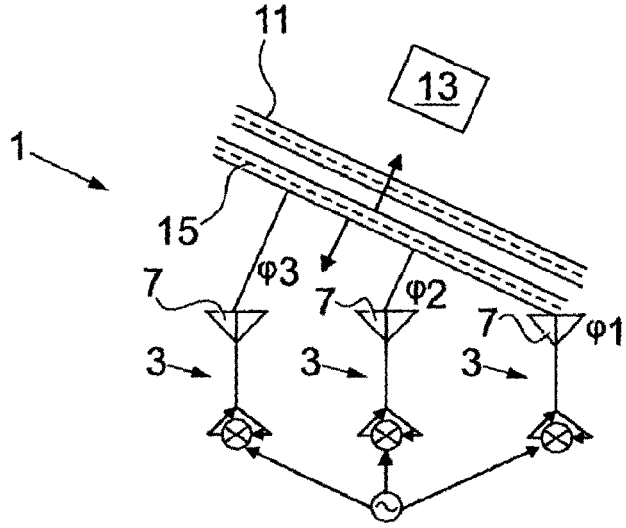
FIG. 1 is a schematic representation of a retrodirective antenna system according to the invention.

Referring to FIG. 1, the retrodirective antenna system 1 comprises three transceiver cells 3. It will be appreciated, however, that other numbers of transceiver cells may be provided. In principle, only two transceiver cells are needed for operation of the antenna system, although for a working system, at least four cells are generally provided. A spacing of approximately 0.3λ to approximately 0.8λ is provided between the cells (where λ is the wavelength of a signal emitted by the cells). It will be appreciated that other cell spacing may be used. In principle, only a spacing of greater than zero is required for operation of the antenna system. In this embodiment of the antenna system of the invention, the transceiver cells 3 are arranged in a linear array, as shown. It will be appreciated, however, that the cell layout does not need to be regular, the cells can be arbitrarily positioned with respect to each other.

Each transceiver cell 3 comprises an antenna component 7. Each transceiver cell 3 outputs an output signal from its antenna component 7, which output signals combine to form an outgoing signal 11. The outgoing signal 11 can be a wide angle, continuous wave (CW) signal, having a frequency in the radio frequency (RF) range. The outgoing signal 11 may impinge on an object 13, situated within the range of the signal 11. The object 13 may scatter an incoming signal 15 back to the antenna system 1. Additionally or alternatively, the object 13 can be active and can emit an incoming signal 15 to the antenna system 1. The incoming signal 15 may be a CW signal, or may comprise some type of modulation. The incoming signal 15 is in the form of a wavefront, and impinges on the array of transceiver cells 3. The antenna component 7 of each transceiver cell 3 detects a part of the incoming signal 15. Each transceiver cell 3 receives a part of the incoming signal at a different time than each other cell. This results in the parts of the incoming signal received by each of the transceiver cells 3 having different phases, $\phi_d$, shown as $\phi_1$, ($\phi_2$ and $\phi_3$ in FIG. 1. For each transceiver cell 3, the received part of the incoming signal is passed from the antenna component 7 to a processor, etc. of the cell. Here each part of the incoming signal is processed, and an output signal is produced which has an equal, but opposite, phase to that of the received part of the incoming signal. The output signals are passed to the antenna components 7 of the cells 3, and are output therefrom. The output signals combine to form a further outgoing signal. As each output signal is the phase conjugate of its part of the incoming signal, wave interference principles will dictate that the further outgoing signal will be propagated in a direction such that it is directed back to the object 13. Thus the antenna system 1 acts as a retrodirective antenna system.

Figure 2:
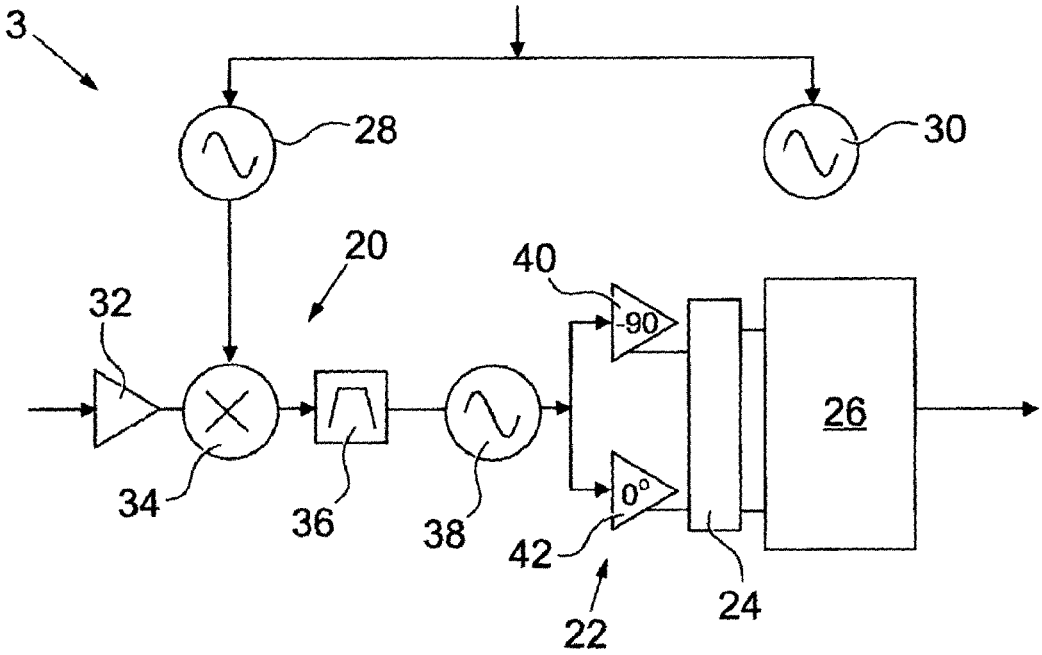
FIG. 2 is a schematic representation of the components of one of the transceiver cells of FIG. 1.

The operation of each transceiver cell 3 of the retrodirective antenna system 1 is now described in detail, with reference to FIGS. 2 to 5. As shown in FIG. 2, the transceiver cell 3 comprises a processor 20, a phase shift system 22, a switching mechanism 24, an IQ modulator 26, a first LO PLL circuit 28 and a second LO PLL circuit 30.

The processor 20 comprises a low noise amplifier 32, a frequency downconverter/mixer unit 34, a sideband signal filter 36, and a tracking PLL circuit 38.

The low noise amplifier 32 receives the part of the incoming signal from the antenna component 7 of the transceiver cell 3. The amplifier 32 amplifies the part of the incoming signal, and passes the signal to the unit 34. The first LO PLL circuit 28 produces a reference signal, which is output to the unit 34. The first LO PLL circuit 28 also outputs the reference signal to the antenna component 7 of the transceiver cell 3. Thus, in this embodiment, the first LO PLL circuit 28 also acts as a source of the output signal initially output by each antenna component 7 of each transceiver cell 3 of the retrodirective antenna system 1.

The frequency downconverter/mixer unit 34 comprises a conventional frequency downconverter and mixer. The unit 34 may comprise diode nonlinear elements or transistor elements biased for nonlinear operation. In a preferred embodiment, the unit 34 comprises a double balanced mixer. This reduces the leakage between an RF incoming signal and an IF output signal and between an RF reference signal and a downconverted IF reference signal. The frequency downconverter of the unit 34 downconverts the frequency of the part of the incoming signal from an RF signal to an IF incoming signal. The frequency downconverter of the unit 34 also downconverts the frequency of the reference signal from an RF signal to an IF reference signal. The mixer then mixes the IF reference signal with the IF incoming signal, to produce a mixed signal. The mixed signal comprises a LSB signal and a USB signal. The mixed signal comprising both sideband signals is output to the sideband signal filter 36.

The sideband signal filter 36 comprises a conventional operational amplifier. The passband of the op-amp can be controlled to filter out either the LSB signal or the USB signal from the mixed signal, and allow either the USB signal or the LSB signal to pass. The passband of the op-amp may be controlled electronically by varying the capacitance of feedback capacitors of the op-amp. The sideband signal filter 36 thus outputs either a LSB signal or a USB signal to the tracking PLL circuit 38.

The tracking PLL circuit 38 duplicates the LSB signal or the USB signal, and outputs either two LSB signals or two USB signals. The tracking PLL circuit 38 may also receive a DC bias signal. The magnitude of this DC bias signal may be varied, to introduce variation in the phase of the LSB signals or the USB signals, i.e. to phase modulate the LSB signals or the USB signals. Thus the LSB signals or the USB signals can be made to carry information. The sideband signal filter 36 and the tracking PLL circuit 38 also act to allow recovery of weak LSB or USB signals.

Figure 3:
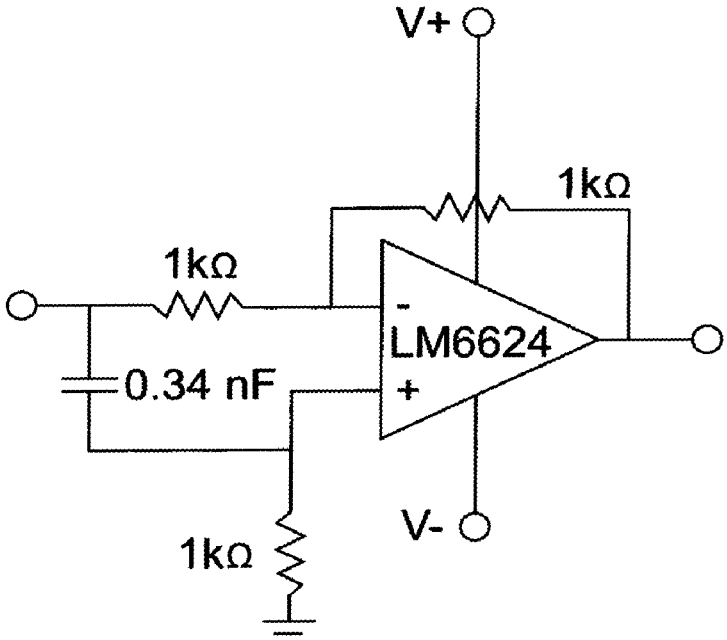
FIG. 3 is a schematic representation of a phase shifter of the transceiver cell of FIG. 2.

The LSB signals or the USB signals output by the tracking PLL circuit 38, are input into the phase shift system 22. This comprises a first phase element 40 and a second phase element 42, each of which comprises a feedback amplifier and associated components. In this embodiment, the first phase element 40 comprises a minus 90 degree phase shifter, as shown in FIG. 3, and adds a minus 90 degree phase shift to the signal it receives. This phase shift is obtained by using a phase lead circuit comprising the capacitor in the feedback loop of the feedback amplifier of the phase element. The second phase element 42 comprises a feedback amplifier and components as shown in FIG. 3, with the exception of the capacitor. Therefore no phase shift is introduced, and the second phase element 42 merely passes the signal it receives, without changing its phase. The resistor components of the phase elements are chosen to equalise the amplitudes of the signals output by the elements. It will appreciated that the values of the resistor and capacitor components etc. shown in the figure are representative only, and other values may be used.

The first phase element 40 therefore receives an LSB signal and outputs an LSB signal having a first phase or receives a USB signal and outputs a USB signal having a first phase, and the second phase element 42 receives an LSB signal and outputs an LSB signal having a second phase which is in quadrature with the first phase or receives a USB signal and outputs a USB signal having a second phase which is in quadrature with the first phase. It will be appreciated that other arrangements of the phase elements 40, 42 can be used, for example the first phase element 40 may comprise a 270 degree phase shifter, and add a 270 degree phase shift to the signal it receives, and the second phase element 42 may merely pass the signal it receives, without changing its phase.

Figure 4:
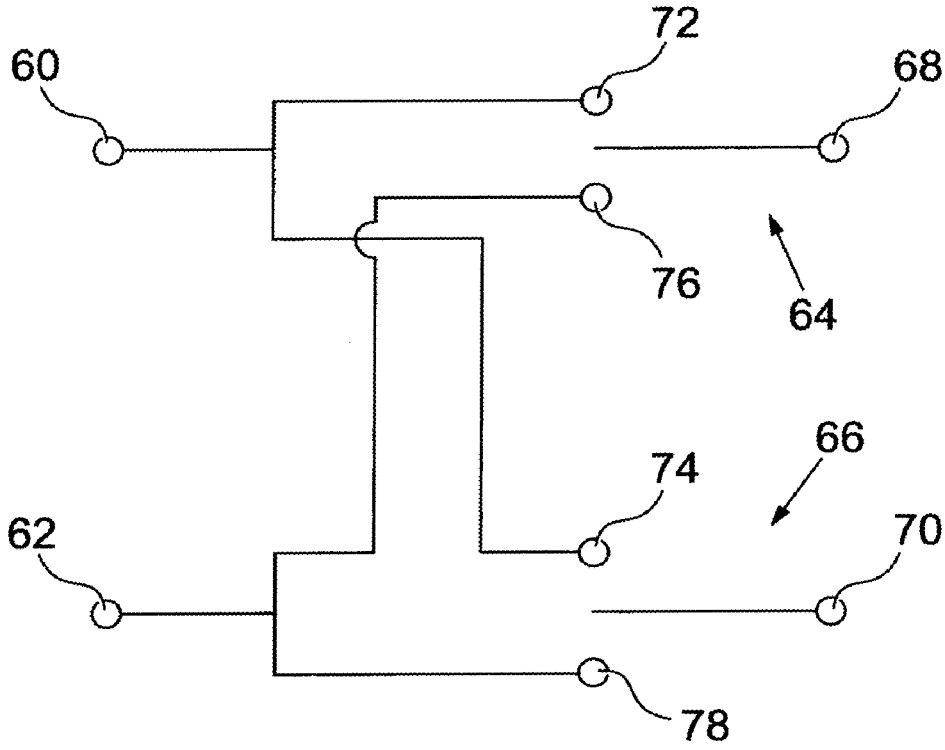
FIG. 4 is a schematic representation of a switching mechanism of the transceiver cell of FIG. 2.
Figure 5:
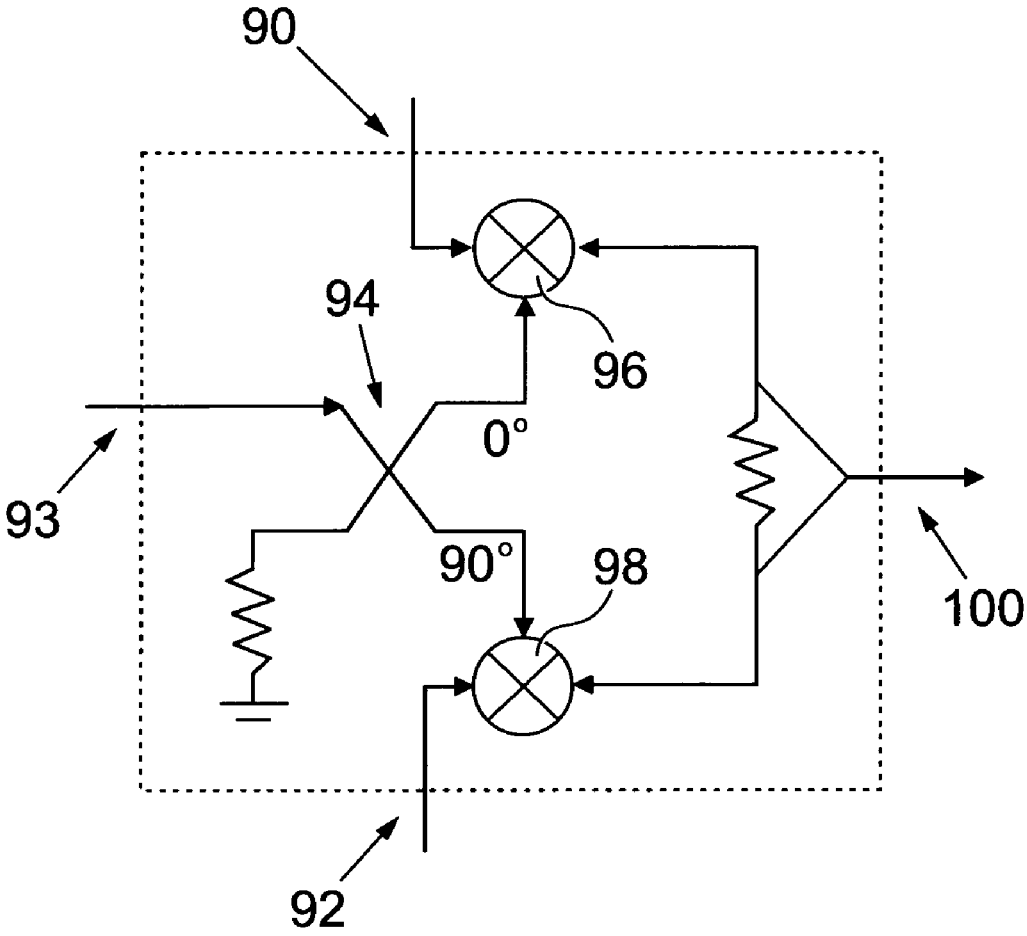
FIG. 5 is a schematic representation of an IQ modulator of the transceiver cell of FIG. 2.

The LSB signals or the USB signals are then passed to the switching mechanism 24, as shown in FIG. 4. This comprises a first input port 60, a second input port 62, a first single pole, single throw switch 64, a second single pole, single throw switch 66, a first output port 68 and a second output port 70. The first input port 60 is connected to the first element 40 of the phase shift system 22, and the second input port 62 is connected to the second phase element 42 of the phase shift system 22. The first input port 60 is connected to switch contacts 72, 74, as shown. The second input port 62 is connected to switch contacts 76, 78, as shown. The first switch 64 is operable to cause a switch lever to contact either the switch contact 72 or the switch contact 76. The second switch 66 is operable to cause a switch lever to contact either the switch contact 74 or the switch contact 78. Control of the operation of the switches 64, 66 is achieved using commands sent to the switches via control lines a and $\bar{a}$.

The switching mechanism 24 receives either LSB signals or USB signals. The switching mechanism 24 receives the LSB signal having the first phase (−90) from the first phase element 40 on the input port 60, and passes this signal to switch contacts 72 and 74. The switching mechanism also receives the LSB signal having the second phase (0) from the second phase element 42, and passes this signal to switch contacts 76 and 78. A control signal is sent to the first switch 64 via control line a, which causes the switch lever of this switch to contact the switch contact 76. A control signal is also sent to the second switch 66 via control line $\bar{a}$, which causes the switch lever of this switch to contact the switch contact 74. Thus the LSB signal having the second phase (0) is passed to the first output port 68, and the LSB signal having the first phase (−90) is passed to the second output port 70.

Alternatively, the switching mechanism 24 receives the USB signal having the first phase (−90) from the first phase element 40 on the input port 60, and passes this signal to switch contacts 72 and 74. The switching mechanism also receives the USB signal having the second phase (0) from the second phase element 42, and passes this signal to switch contacts 76 and 78. A control signal is sent to the first switch 64 via control line a, which causes the switch lever of this switch to contact the switch contact 72. A control signal is also sent to the second switch 66 via control line $\bar{a}$, which causes the switch lever of this switch to contact the switch contact 78. Thus the USB signal having the second phase (0) is passed to the second output port 70, and the USB signal having the first phase (−90) is passed to the first output port 68.

The signals on the first and second output ports of the switching mechanism 24 are passed to the IQ modulator 26. This comprises an I input port 90, a Q input port 92, a reference signal input port 93, a 90 degree hybrid coupler 94, a first mixer 96, a second mixer 98, and an output port 100. The first output port 68 of the switching mechanism 24 is connected to the I input port 90, and the second output port 70 of the switching mechanism 24 is connected to the Q input port 92. The second LO PLL circuit 30 is connected to the reference signal input port 93.

The IQ modulator 26 receives either LSB signals or USB signals. The IQ modulator 26 receives the LSB signal having the first phase (−90) on the Q input port 92 and receives the LSB signal having the second phase (0) on the I input port 90. The reference signal received on the reference signal input port 93 is input into the 90 degree hybrid coupler 94. The coupler 94 produces a first signal which is input into the first mixer 96 and a second signal which is input into the second mixer 98. The signals are in phase quadrature. The first mixer 96 receives the first signal from the coupler 94 and the LSB signal having the second phase (0) from the I input port 90. The first mixer 96 acts to mix these signals and produces an output signal. The second mixer 98 receives the second signal from the coupler 94 and the LSB signal having the first phase (−90) from the Q input port 92. The second mixer 98 acts to mix these signals and produces an output signal. The output signals from the first and second mixers are combined, and output from the IQ modulator 26 via the output port 100. The components of the IQ modulator 26 act to phase adjust the LSB signals, as necessary, to produce an output signal at the output port 100 which is the phase conjugate of the part of the incoming signal first received from the antenna component 7 of the transceiver cell 3 comprising the IQ modulator 26.

Alternatively, the IQ modulator 26 receives the USB signal having the second phase (0) on the Q input port 92 and receives the USB signal having the first phase (−90) on the I input port 90. The reference signal received on the reference signal input port 93 is again input into the 90 degree hybrid coupler 94. The coupler 94 produces a first signal which is input into the first mixer 96 and a second signal which is input into the second mixer 98. The signals are again in phase quadrature. The first mixer 96 receives the first signal from the coupler 94 and the USB signal having the first phase (−90) from the I input port 90. The first mixer 96 acts to mix these signals and produces an output signal. The second mixer 98 receives the second signal from the coupler 94 and the USB signal having the second phase (0) from the Q input port 92. The second mixer 98 acts to mix these signals and produces an output signal. The output signals from the first and second mixers are combined, and output from the IQ modulator 26 via the output port 100. The components of the IQ modulator 26 act to phase adjust the USB signals, as necessary, to produce an output signal at the output port 100 which is the phase conjugate of the part of the incoming signal first received from the antenna component 7 of the transceiver cell 3 comprising the IQ modulator 26.

The IQ modulator 26 also acts to upconvert the frequency of the LSB signals or USB signals which it receives, from IF signals to an RF output signal. The IQ modulator 26 receives an RF reference signal from the second LO PLL circuit 30. On mixing this with the IF signals received on the I and Q input ports, an RF output signal is obtained.

The IQ modulator 26 may be used to produce an amplitude modulated, phase conjugate output signal. I, Q bit patterns are applied to the first and second mixers, in order to switch them on and off, thus amplitude modulating their output signals.

The first LO PLL circuit 28 and the second LO PLL circuit 30 are phase synchronised, as they receive a common low frequency input signal and use this to produce their reference signals. (This common low frequency input signal is distributed across the array of transceiver cells 3 of the retrodirective antenna system 1, and is locally available at the LO PLL circuits of each transceiver cell in the array, for the purposes of signal down/up conversion). The use of phase synchronised LO PLL circuits 28, for providing reference signals for down and up conversion, and for providing the output signal initially output by the antenna component 7 of the cell 3, ensures synchronised phase information in the part of the incoming signal received by the transceiver cell 3 and the output signal output by the transceiver cell 3.

Each of the transceiver cells 3 of the retrodirective antenna system 1 outputs an output signal which is the phase conjugate of the part of the incoming signal which it receives. The output signals are passed to the antenna components 7 of the transceiver cells 3, and are output by the cells. The output signals combine to produce an outgoing signal, which is transmitted by the retrodirective antenna system 1. As each output signal is the phase conjugate of its part of the incoming signal, wave interference principles will dictate that the outgoing signal will de directed to the object 13, even if its position is not known a priori. Thus the antenna system 1 acts as a retrodirective antenna system.

As the antenna system 1 is retrodirective it has a high immunity to clutter. Further, the retrodirective antenna system 1 is able to lock onto the source 13, and then follow movement of the source 13. Each transceiver cell 3 may also determine the phase, $\phi_d$, of the part of the incoming signal received by it. This, in turn, can be used to determine the angle of arrival of the incoming signal, and, from this, the position of the source 13.

The architecture of each transceiver cell 3 of the retrodirective antenna system 1 results in there being no requirement for a local oscillator running at twice the frequency of the incoming signal in order for retrodirective action to occur, as is standard practice in known retrodirective antenna designs. This significantly eases the physical local oscillator requirements in practical implementation of the retrodirective antenna system 1.

Use of the phase shift system 22, the switching mechanism 24 and the IQ modulator 26, in each of the transceiver cells 3, allows production by the IQ modulator 26 of an output signal which is very close in frequency to the part of the incoming signal received by the transceiver cell 3. In conventional upconverter/mixer arrangements, if an output signal is generated which is very close in frequency to a received input signal, sufficient leakage occurs through the upconverter/mixer to destroy the output signal. Using the arrangement according to the invention, allows this leakage to be cancelled. Thus the retrodirective antenna system 1 can use a narrow bandwidth for the input and output signals. This results in good signal to noise ratio, good 'rejection' of thermal noise, low power and difficulty for a third party to identify or jam the input or output signals.

In an alternative embodiment of the retrodirective antenna system of the invention, the sideband signal filter 36 is set to output a LSB signal. This is input into the tracking PLL circuit 38 which duplicates it, and outputs two LSB signals. The LSB signals are input into the phase shift system 22. The first phase element 40 of the system 22 receives an LSB signal and outputs an LSB signal having a first (−90) phase, and the second phase element 42 receives an LSB signal and outputs an LSB signal having a second phase (0), which is in quadrature with the first phase. The LSB signals output by the phase shift system 22 are then directly input into the IQ modulator 26, i.e. no switching mechanism 24 is required. The output of the first phase element 40 is directly connected to the Q input port 92 of the IQ modulator 26, and the output of the second phase element 42 is directly connected to the I input port 90 of the IQ modulator 26. The modulator 26 acts on the LSB signals as previously described, to produce an output signal at the output port 100 which is the phase conjugate of the part of the incoming signal first received from the antenna component 7 of the transceiver cell 3 comprising the IQ modulator 26.

In a further embodiment of the retrodirective antenna system of the invention, the sideband signal filter 36 is set to output a USB signal. This is input into the tracking PLL circuit 38 which duplicates it, and outputs two USB signals. The USB signals are input into the phase shift system 22. The first phase element 40 of the system 22 receives a USB signal and outputs a USB signal having a first (−90) phase, and the second phase element 42 receives a USB signal and outputs a USB signal having a second phase (0), which is in quadrature with the first phase. The USB signals output by the phase shift system 22 are then directly input into the IQ modulator 26, i.e. again no switching mechanism 24 is required. The output of the first phase element 40 is directly connected to the I input port 90 of the IQ modulator 26, and the output of the second phase element 42 is directly connected to the Q input port 92 of the IQ modulator 26. The modulator 26 acts on the USB signals as previously described, to produce an output signal at the output port 100 which is the phase conjugate of the part of the incoming signal first received from the antenna component 7 of the transceiver cell 3 comprising the IQ modulator 26.

The retrodirective antenna system of the invention can be used in a plurality of applications, some of which are described below.

The retrodirective antenna system of the invention may be used as a retrodirective radar system, for the detection of objects. The retrodirective antenna system is capable of detecting objects very quickly, in comparison to known antenna systems. The retrodirective antenna system is therefore particularly useful for detecting objects in the short range. Objects which can therefore usefully be detected include birds flying close to aeroplanes. The retrodirective antenna system can also be used to track an object, once this has been detected. This could be used, for example, to determine if a bird is in danger of being trapped by an engine of an aeroplane. Such bearing tracking and ranging could be readily implemented by using pseudo random pulse modulation in the retransmit signal and thereafter deploying classical correlation to the incoming signals. The retrodirective antenna system can be further used to determine the position of the object.

The retrodirective antenna system of the invention may be attached to a first object, and used to send signals to a second object. Signals will be transmitted to the second object even if the second object, and, indeed, the first object, are moving. The signals could be used, for example, to send information to the second object, and/or to control operation of the second object. In addition to this simplex communication, duplex communication is also possible. Signals received by the retrodirective antenna system 1 from the second object may comprise information, for example, on the operation of the second object.

The retrodirective antenna system of the invention can be used in a beam steering system. The beam steering system comprises a retrodirective antenna system and a plurality of small-sized objects positioned in the near field of the retrodirective antenna system. The objects may be passive and act to backscatter a signal emitted by the retrodirective antenna system. When the antenna system emits a signal, and receives an incoming signal scattered from an object, the antenna system is able to lock onto the object, and send a signal back to it. Additionally or alternatively, the objects may be active, and act to transmit signals to the retrodirective antenna system. The objects may be sequentially activated, to transmit signals to the antenna system. When the retrodirective antenna system receives an incoming signal transmitted by an object, the antenna system is again able to lock onto the object, and send a signal back to it. In each case, since the objects are placed in the near field of the retrodirective antenna system, the signal returned to them will largely bypass them, and be projected to spatial positions beyond the objects. Thus the signals emitted by the retrodirective antenna system can be steered to positions beyond the objects, and the system as a whole act as a beam steering system.

The retrodirective antenna system of the invention may also be used as part of an electromagnetic perimeter fence. This comprises a retrodirective antenna system and one or more objects placed at positions relative to the antenna system so that a signal path or paths between the antenna system and the object or objects enclose a space to be protected, i.e. form an electromagnetic perimeter fence around the space. The object or objects may be so positioned to provide a direct line of sight between the retrodirective antenna system and an object, or the direct line of sight can be folded by use of, for example, metallic reflectors. Once in position, the retrodirective antenna system may be used to emit a signal, backscattered signals from the or each object are detected by the antenna system, which then acts to transmit a continuous signal to the object or objects. Additionally or alternatively, the object or objects may transmit a signal to the retrodirective antenna signal, these signals are detected by the antenna system, which then acts to transmit a continuous signal to the object or objects. In each case, the level of the signal transmitted to the or each object is monitored by the retrodirective antenna system. If an article, for example a human, intrudes into the path of the signal, the signal level will drop, and an alarm can be raised. Thus if an article attempts to enter the space protected by the electromagnetic perimeter fence, an alarm can be raised. The electromagnetic perimeter fence comprising the retrodirective antenna system of the invention is considerably less prone to false detection than currently-available fence systems. Thus is a result of the retrodirective action of the antenna system, where the system can lock onto an object and a signal can be transmitted directly to the object. Thus the system is sensitive to articles intruding into the signal between the retrodirective antenna system and an object, but is relatively immune to signal clutter introduced by articles, such as trees, which are moving around the signal path, e.g. in the far field of the antenna system. If the perimeter fence has to be has to be deactivated for any reason, for example to allow an article into the space within the fence, then the antenna system can automatically relocate the or each object, using the signal emitted by the object, and automatically re-establish a signal path between the antenna system and the or each object. It is to be noted that if the antenna system used in the perimeter fence comprises only one transceiver cell instead of a plurality of cells, then the perimeter fence would still operate as above, minus the automatic realignment capability.

The retrodirective antenna system of the invention may further be used in a radio therapy/ablation system. The radio therapy/ablation system comprises a retrodirective antenna system, a target, and a source of radio signals. The target is positioned on an object, such as a tumour, requiring treatment with or ablation by the radio signals. The retrodirective antenna system is used to transmit a signal towards the target. On receipt of the signal, the target either scatters the signal back towards the antenna system, and/or transmits a signal back towards the antenna system. On receiving the signal from the target, the retrodirective antenna system can lock onto the target's position. The source of radio signals can then direct a beam of radio signals to the target, and the object on which it is positioned, the signals having a frequency suitable selected for the treatment/ablation type required. If the target is designed to only backscatter the signal transmitted by the antenna system, i.e. the target has no receive capacity, the target can be made particularly small, increasing the area of the object which can be treated with the radio signals. If the object, and therefore the target, is moving, this is of limited consequence, as the retrodirective antenna system is still able to lock onto the target and direct radio signals to the target and object. This allows tumours or defects in areas where movement is likely to occur, e.g. the heart or lungs, to be treated without administering external means for slowing their movement.

In each of the above applications, use of a retrodirective antenna system according to the invention provides a retrodirective function, using a relatively simple, and cheap, antenna system.

The invention claimed is:

1. A retrodirective antenna system for receiving an incoming signal from an object and directing an outgoing signal back to the object, comprising:

two or more transceiver cells, each of which receives a part of the incoming signal, produces a phase conjugate output signal, which output signals from the cells combine to form an outgoing signal directed back to the object;

wherein each transceiver cell comprises:

an antenna component which detects the part of the incoming signal;

a processor which receives the part of the incoming signal and produces first and second same-side, sideband (SB) signals of the part of the incoming signal;

a phase shift system comprising a first phase element which receives the first SB signal and outputs a SB signal having a first phase, and a second phase element which receives the second SB signal and outputs a SB signal having a second phase which is in quadrature with the first phase; and an IQ modulator comprising an I input port, a Q input port and a phase adjuster, which receives the SB signal having the first phase on the I input port and the SB signal having the second phase on the Q input port, or receives the SB signal having the first phase on the Q input port and the SB signal having the second phase on the I input port, and phase adjusts the SB signals to produce an output signal which is the phase conjugate of the part of the incoming signal.

2. A system according to claim 1, wherein the first and second SB signals are lower sideband (LSB) signals, the phase shift system outputs a LSB signal having a first phase and a LSB signal having a second phase which is in quadrature with the first phase, and the IQ modulator receives the LSB signal having the first phase on the Q input port and the LSB signal having the second phase on the I input port, and phase adjusts the LSB signals to produce an output signal which is the phase conjugate of the part of the incoming signal.

3. A system according to claim 1, wherein the first and second SB signals are upper sideband (USB) signals, the phase shift system outputs a USB signal having a first phase and a USB signal having a second phase which is in quadrature with the first phase, and the IQ modulator receives the USB signal having the first phase on the I input port and the USB signal having the second phase on the Q input port, and phase adjusts the USB signals to produce an output signal which is the phase conjugate of the part of the incoming signal.

4. A system according to claim 1, wherein the first and second SB signals are LSB signals or USB signals, the phase shift system receives LSB signals and outputs a LSB signal having a first phase and a LSB signal having a second phase which is in quadrature with the first phase, or the phase shift system receives USB signals and outputs a USB signal having a first phase and a USB signal having a second phase which is in quadrature with the first phase, the system further comprises a switching mechanism, the switching mechanism receives the LSB signal having the first phase and the LSB signal having the second phase and switches the LSB signal having the first phase to the Q input port of the IQ modulator and switches the LSB signal having the second phase to the I input port of the IQ modulator, or the switching mechanism receives the USB signal having the first phase and the USB signal having the second phase and switches the USB signal having the first phase to the I input port of the IQ modulator and switches the USB signal having the second phase to the Q input port of the IQ modulator.

5. A system according to claim 1, wherein the processor comprises a frequency downconverter/mixer unit, and the unit comprises a frequency downconverter which downconverts the frequency of the part of the incoming signal from an RF signal to an IF part of the incoming signal, and receives a reference signal and downconverts the frequency of the reference signal from an RF signal to an IF reference signal, and a mixer which receives the IF reference signal and the IF part of the incoming signal, and mixes these to produce a mixed signal comprising a LSB signal and a USB signal.

6. A system according to claim 1, wherein the processor comprises a sideband signal filter comprising an operational amplifier, the passband of which is controlled to pass a SB signal comprising a LSB signal or a USB signal.

7. A system according to claim 6, wherein the sideband signal filter receives the mixed signal and the passband of the operational amplifier is controlled to filter out either the LSB signal or the USB signal from the mixed signal, and allow either the USB signal or the LSB signal of the mixed signal to pass.

8. A system according to claim 1, wherein the processor comprises a tracking phase locked loop (PLL) circuit, and the tracking PLL circuit receives a SB signal and duplicates the SB signal to produce the first and second same-side SB signals.

9. A system according to claim 8, wherein the tracking PLL circuit receives a DC bias signal and the magnitude of the DC bias signal is varied, to introduce variation in the phase of the SB signals, i.e. to phase modulate the SB signals.

10. A system according to claim 1, wherein the first phase element comprises a minus 90 degree phase shifter and produces a SB signal having a first phase which has a minus 90 degree phase shift in comparison to the first SB signal, and the second phase element acts to pass the second SB signal, without changing its phase, producing a SB signal having a second phase which has a 0 degree phase shift in comparison to the second SB signal.

11. A system according to claim 1, wherein the phase adjuster of the IQ modulator comprises a 90 degree hybrid coupler, a first mixer, a second mixer, a reference signal input port, and an output port, and a reference signal received on the reference signal input port is input into the 90 degree hybrid coupler which produces a first signal which is input into the first mixer and a second signal which is input into the second mixer, the first mixer receives the first signal from the coupler and the SB signal from the I input port and acts to mix these signals and produce an output signal, the second mixer receives the second signal from the coupler and the SB signal from the Q input port and acts to mix these signals and produce an output signal, and the output signals from the first and second mixers are combined, and output from the IQ modulator via the output port.

12. A system according to claim 11, wherein the IQ modulator acts to upconvert the frequency of the SB signals which it receives, from IF signals to an RF output signal.

13. A system according to claim 1, comprising:

a first LO PLL circuit which inputs a reference signal into the processor, and a second LO PLL circuit which inputs a reference signal into the IQ modulator, and the first and second LO PLL circuits are phase synchronised by receiving a common low frequency input signal and using this to produce their reference signals.

14. A method of receiving an incoming signal from an object and directing an outgoing signal back to the object, comprising:

receiving by each of two or more transceiver cells, a part of the incoming signal:

producing a phase conjugate output signal from each of the cells, which output signals combine to form an outgoing signal directed back to the object;

wherein for each transceiver cell an antenna component of the transceiver cell detects the part of the incoming signal;

a processor of the transceiver cell receives the part of the incoming signal and produces first and second same-side, sideband (SB) signals of the part of the incoming signal;

a first phase element of a phase shift system of the transceiver cell receives the first SB signal and outputs a SB signal having a first phase, and a second phase element of the phase shift system of the transceiver cell receives the second SB signal and outputs a SB signal having a second phase which is in quadrature with the first phase; and an I input port of an IQ modulator of the transceiver cell receives the SB signal having the first phase, and a Q input port of the IQ modulator of the transceiver cell receives the SB signal having the second phase, or the I input port of the IQ modulator of the transceiver cell receives the SB signal having the second phase, and the Q input port of the IQ modulator of the transceiver cell receives the SB signal having the first phase, and a phase adjuster of the IQ modulator of the transceiver cell phase adjusts the SB signals to produce an output signal which is the phase conjugate of the part of the incoming signal.

* * * * *